US012635741B2

(12) United States Patent
Lloyd

(10) Patent No.: US 12,635,741 B2
(45) Date of Patent: May 26, 2026

(54) RIDING JEANS

(71) Applicant: Whitney Lloyd, Delaware, OH (US)

(72) Inventor: Whitney Lloyd, Delaware, OH (US)

( * ) Notice: Subject to any disclaimer, the term of this patent is extended or adjusted under 35 U.S.C. 154(b) by 0 days.

(21) Appl. No.: 19/260,187

(22) Filed: Jul. 3, 2025

(65) Prior Publication Data

US 2026/0076423 A1 Mar. 19, 2026

Related U.S. Application Data

(60) Provisional application No. 63/696,377, filed on Sep. 19, 2024.

(51) Int. Cl.

| | |
|---|---|
| ***A41D 1/086*** | (2018.01) |
| *A41D 1/06* | (2006.01) |
| *A41D 1/08* | (2018.01) |
| *A41D 13/00* | (2006.01) |
| *A41D 27/20* | (2006.01) |

(52) U.S. Cl.

CPC ..... *A41D 1/086* (2013.01); *A41D 1/06* (2013.01); *A41D 1/067* (2013.01); *A41D 1/088* (2013.01); *A41D 13/0012* (2013.01); *A41D 27/205* (2013.01)

(58) Field of Classification Search

CPC ..... A41D 1/086; A41D 1/06; A41D 1/067; A41D 1/088; A41D 13/0012; A41D 27/205

USPC ..... 2/227

See application file for complete search history.

(56) References Cited

U.S. PATENT DOCUMENTS

| | | | | | |
|---|---|---|---|---|---|
| 3,435,462 | A * | 4/1969 | Bank | A41D 1/06 | 2/247 |
| 5,572,737 | A * | 11/1996 | Valice | A41D 13/015 | 2/904 |
| 5,634,215 | A * | 6/1997 | DeBaene | A41D 13/065 | 2/69 |
| 7,793,359 | B2 * | 9/2010 | Spiewak | A41F 5/00 | 2/69 |
| 7,805,774 | B2 * | 10/2010 | Muller | A41D 1/086 | 2/69 |
| 9,801,420 | B2 * | 10/2017 | Hays | A41D 1/06 | |
| 10,154,702 | B1 * | 12/2018 | Neary | A41D 1/06 | |
| 12,048,335 | B2 * | 7/2024 | Power | A41B 9/004 | |
| 2010/0136882 | A1 * | 6/2010 | Malish | A41D 1/06 | 450/11 |
| 2011/0078839 | A1 * | 4/2011 | Leonard | A41D 27/02 | 2/67 |
| 2014/0150166 | A1 * | 6/2014 | Hall | A41D 1/06 | 2/227 |
| 2014/0165265 | A1 * | 6/2014 | Tulin | A41D 1/06 | 2/234 |
| 2014/0352024 | A1 * | 12/2014 | Echigoya | A41D 27/20 | 2/248 |

(Continued)

*Primary Examiner* — Khaled Annis
*Assistant Examiner* — Dakota Marin
(74) *Attorney, Agent, or Firm* — R Lynette Wylie

(57) ABSTRACT

A riding garment, particularly riding jeans, having a heavier density outer portion including a waistband wherefrom an open torso portion is downwardly disposed and an inner support portion configured of a lower density fabric attached to the front side of the waistband with inset front pockets and an obscured cell phone pocket in a rear side having an open top aligned along a seam of a yoke member and disposed behind the periphery of a rear pocket in the outer layer and a gusset member.

19 Claims, 10 Drawing Sheets

(56) References Cited

U.S. PATENT DOCUMENTS

| | | | | |
|---|---|---|---|---|
| 2015/0082516 | A1* | 3/2015 | Doan | A41D 27/20 2/220 |
| 2015/0089716 | A1* | 4/2015 | Gonzales | A41D 1/06 112/475.13 |
| 2015/0196069 | A1* | 7/2015 | Burkhart | A41D 1/062 2/227 |
| 2015/0282535 | A1* | 10/2015 | Rowe | A41F 9/02 2/237 |
| 2015/0313302 | A1* | 11/2015 | Boyle | A41D 27/28 2/227 |
| 2016/0120246 | A1* | 5/2016 | Boyle | A41D 1/06 2/227 |
| 2017/0119065 | A1* | 5/2017 | Boyle | A41D 27/204 |
| 2018/0049497 | A1* | 2/2018 | Benefiel | B41M 5/24 |
| 2019/0110525 | A1* | 4/2019 | Conte | A41D 1/06 |
| 2024/0049819 | A1* | 2/2024 | Miller | A41F 7/00 |

* cited by examiner

RIDING JEANS

CROSS-REFERENCE TO RELATED APPLICATIONS

This Application claims priority to and benefit under 35 USC § 119(e) of U.S. Provisional Patent Application Ser. No. 63/696,377 having a filing date of Sep. 19, 2024 which is hereby incorporated by reference herein.

FIELD OF THE INVENTION

The present invention relates generally to sportswear and more particularly to jeans for riding equestrians.

BACKGROUND OF THE INVENTION

Conventional sportswear including riding jeans do not adequately address the needs of current active lifestyles. In the past, riding jeans were made of cotton denim or similar fabrics that restrict movement, particularly in the crotch region and do not adaptively support a rider's lower abdomen. They further lacked a safe, secure yet discrete pocket for storing a cell phone.

To effect adaptive support and compress unseemly bulges in a wearer's abdomen and thighs, conventional sportswear has incorporate elasticized synthetic fabrics such as Spandex employing relatively high proportions of elastomers, composing for example, 5-10 percent of weight or more of the fabric in order to girdle the abutting abdominal region. However, such elasticized materials retain body heat and cling to a wearer's skin, and are hence prone to causing discomfort particularly when binding about an abdominal region of the wearer.

A further drawback of conventional sportswear is the unseemly telegraphing of underlying body contours, particularly protrusion and undulations of a wearer's underlying abdomen. Rather than compress or flatten the wearer's abdomen, such highly stretchable fabrics may actually accentuate unattractive peaks, creases, valleys and dimpling thereby detracting from a wearer's overall appearance, particularly if disproportionately shaped or obese.

A further drawback of conventional riding garments and other sportswear composed of fabric blends containing elasticized or synthetic materials is their lack of durability. Elasticized fabrics such as Spandex are prone to losing their shape and compressive functionality after numerous wearings and washings. The lifespan of such fabrics is therefore shorter than fibers with lower proportions of elastomers.

Further drawbacks of conventional sportswear include the lack of discrete or hidden yet secure stowing of a cell phone due to protruding profiles of pockets overlayed by such stretchable fabrics. When stowed in rear pockets of conventional riding jeans, a cell phone protrudes above the open top and thus readily seen and dislodged, particularly when a wearer is engaged in riding or a similar rigorous activity.

Hence, there persists a need for a riding garment design that simultaneously provides abdominal support that is cool, comfortable and durable while also imparting a pleasing appearance and discrete, secure stowing of a cell phone or other personal item.

SUMMARY OF THE INVENTION

Addressing such and other unsolved problems and persisting needs, the invention described and claimed herein is drawn toward riding garments that enhance projecting a smooth esthetic together with providing flexibly adaptive support of the abdomen and secure stowing of a cell phone. According to various embodiments of the present invention, this riding garment includes an outer portion configured to cover at least a portion of a wearer's lower torso that is composed of a heavy density fabric and an inner support portion affixed to the waistband composed of a light density fabric that may be adjoined to opposed side seams of the outer portion.

In various embodiments, the open torso portion bifurcates into a pair of integral leg members at a crotch region of the open torso portion. Such embodiments may further include a gusset member configured to adjoin the front side and the rear side where the open torso portion bifurcates such that the pair of opposed inner seams and the front seam and the rear seam are spaced apart to thereby eliminate a cross intersection of the inner seams with the front and the rear seams.

Embodiments may further feature at least one rear outer pocket disposed on the rear side of the open torso portion and a cell phone pocket disposed in the rear panel of the open torso portion extending downwardly from an open top so as to align the at least one rear outer pocket so that at least a lower portion of the cell phone pocket is disposed behind a periphery of the rear outer pocket to thereby hide or at least obscure the cell phone behind the at least one of the rear pockets when stowed in the cell phone pocket.

In various embodiments, the outer portion may be composed of a moderate or heavy weight denim. The outer portion and the inner support portion of some embodiments may include a small proportion of less than 3 percent by weight of an elastomer such as elastane, Spandex or Lycra®. Such minimal elastomer content provides the advantages of imparting some flexibility without altering the characteristics, including the esthetic appearance and texture of dominant thread or material of the respective fabrics and avoids binding or clinging to a wearer's skin or an abutting layer of fabric.

In various embodiments, the inner support portion is configured to cover at least a lower portion of a wearer's abdomen and has a top portion adjoined to the waistband. In some embodiments, side seams of the inner support portion are adjoined to opposed side seams of front side and rear side. The inner support portion may be composed of a flexible yet breathable and durable lighter density fabric composed of less than 3 percent by weight of an elasticized material.

The differential densities combined with minimal proportion of elastomer or similar stretchable component of the high density outer and light density inner support portions impart a low coefficient of friction preventing the layers from clinging or gathering in the abdominal region wherein they are abutted. Due to the small proportion of elastane material, the fabrics retain the characteristics and properties of the much higher proportions of cotton, polyester or other non-stretchable threads of which they are composed. As a result, the outer portion and inner support portions lack the clinging or binding action and heat retention and associated discomfort of conventional Spandex or Lycra® containing fabrics. The smoother and softer texture impart minimal or no friction between abutting surfaces of the outer and inner support portion and retain a breathable matrix enabling dissipation of body heat and perspiration thereby enhancing a wearer's comfort. In addition, the respective differential in the woven threads of abutting surfaces of the outer portion's higher density fabric and the inner support portion's lower density fabric are also conducive to a low coefficient of friction promoting smooth draping and coverage of a wearer's abdomen minimizing unseemly gathering or clinging.

The inner support portion may be a single layer or dual layers. In various embodiments, an upper portion of a first layer is adjoined to the waistband and the upper edge of a second layer is adjoined to a pair of opposed pocket openings disposed equidistantly about a midline of the front side and a seam defining a periphery of a pair of inset pockets.

In various embodiments, the outer portion may include a front portion with a vertical split having fastenable aligned edges vertically disposed downwardly from a top edge of the waistband toward a crotch region. When fastened, for example, by closing a zipper, aligned edges of the vertical split are coupled in parallel alignment such that the riding garment may enclose a wearer's lower torso. Various commercially available fasteners may be employed to thus fasten the aligned edges.

Various embodiments feature front pockets defined by a periphery adjoining the first layer and the second layer interfacing the outer portion In some embodiments, the inner support portion features front inset pockets configured by adjoining the first layer to an edge of the front side of the outer layer spaced down from the waistband such that the first layer and the second layer extend downwardly from each of a pair of pocket openings flanking a vertical split of the open torso portion 2.

It is contemplated that alternative embodiments may include further layers or patches in order to provide added support and/or protection for targeted body parts of the wearer.

Various embodiments further feature a cell phone pocket disposed from a pocket opening in the rear side of the outer portion. In some embodiments, at least a lower portion of the cell phone pocket is positioned directly behind a rear pocket imparting the added functionality of providing a protective interfacing layer of a heavy density fabric attenuating any impact imposed from an exterior force on a cell phone. In some embodiments, a protective second layer to further shield the cell phone may be affixed to the cell phone pocket. The heavy density fabric thus protects the cell phone from impacts imposed when the wearer rocks, jumps or is bumped up, down and around or even thrown off a horse, bicycle, motorized sports equipment, or participating in some other activity.

Positioning a lower portion of the cell phone pocket wherein a cell phone is lodged behind the periphery of a rear pocket discretely conceals or at least obscures visibility of the cell phone. In some embodiments, a portion of the cell phone pocket is composed of the heavier weight fabric that may be a denim fabric. Disposing a heavy density fabric of the outer portion downward from an upper periphery of the pocket facilitates smooth insertion and removal of a cell phone therefrom. It is contemplated that the cell phone pocket be composed of fabric that is durable yet flexibly adaptive for snug stowing the cell phone inside the cell phone pocket enclosure.

In various embodiments, the outer portion includes a pair of leg members extending downwardly from a bifurcated midportion of a crotch region.

Various embodiments further feature a yoke member having an upper parallelogram-shaped portion adjoined to the waistband and an integral lower triangulate portion having opposed V-shape edges tapering upwardly from a midline of the rear side. In such embodiments, an open top of the cell phone pocket may be coextensively aligned along a portion of the V-shaped opposed edges.

A portion or all of the cell phone pocket and/or inner support portion of the various embodiments may be composed with an array of various synthetic and natural woven fibers. Some embodiments may incorporate adaptively flexible blends such as nylon, elastane, Spandex, Lycra® and/or a polyester. Varied size thread sizes, count and weave spacing ranging from a solid weave to a mesh matrix may be used to provide desired combination of adaptive flexibility the comfortably moves in tandem with the wearer's body, particularly capable of adapting to rapid changes in position or impacts such as, for example, stepping or jumping on and off a horse or bull, mechanical or powered recreational machine, bumping and gripping of the animal or machine when riding and engaging in other activities involving lower body movement and flex while maintaining a cell phone and other contents of the pockets secured therein. Suitable fabrics and configurations thus keep the cell phone or contents snug and secure within the pocket and conform to the wearer's posterior or rear side when the wearer is in various positions, i.e., standing, seated, bent over, and in motion.

Various embodiments may further include a gusset member configured to underly a wearer's crotch region. A periphery of the gusset member corresponding to the bottom inner edge of the open torso portion is configured to adjoin the front side and rear side where the open torso portion bifurcates such that the pair of opposed inner seams and the front seam and the rear seam are spaced apart to thereby eliminate a cross intersection of the inner seams with the front and the rear seams. The gusset member may be continuously adjoined to the bottom inner edge so as to adjoin the front side and rear side where the outer portion bifurcates into the pair of integral leg members. In some embodiments, the gusset member may also extend toward the front side and/or rear side above where the outer portion bifurcates, and may also extend downwardly to the inner side of the leg members.

The outer portion of various embodiments of the present invention may be composed of a heavy or moderate density fabric such as denim. In some embodiments, the riding jean's outer portion may be composed of a two-ply or three-ply twill denim fabric having a weight of between 8 and about 16 ounces per square yard.

As used herein, a "heavy density fabric" weighs between 7 ounces per square yard and 16 ounces per square yard and may be woven from two-ply or three-ply threads and can feature a twill weave including a denim twill. Such a heavier density fabric may in some embodiments include a small amount of less than 3 percent by weight of a stretchable component including elastane such as Spandex, Lycra® or a nylon.

As used herein, a "light density fabric" weighs between 2 ounces per square yard and 6 ounces per square yard and is composed of a woven blend of cotton and a synthetic material, such as nylon or polyester. Such a lighter density fabric may in some embodiments include small amount of less than 3 percent by weight of a stretchable component such as elastane, including Spandex and Lycra® or a nylon.

As used herein, "bifurcates" refers to the point or area at which the outer portion divides into leg members, i.e., where bifurcating occurs.

As used herein, "denim" refers to a fabric composed of at least 97 percent cotton thread. Other non-cotton elements of the fabric may include a small amount of synthetic material, such as, elastane, Spandex or Lycra® to enhance comfort and movement of the wearer.

DETAILED DESCRIPTION OF THE ILLUSTRATED EMBODIMENT

Figure 1:
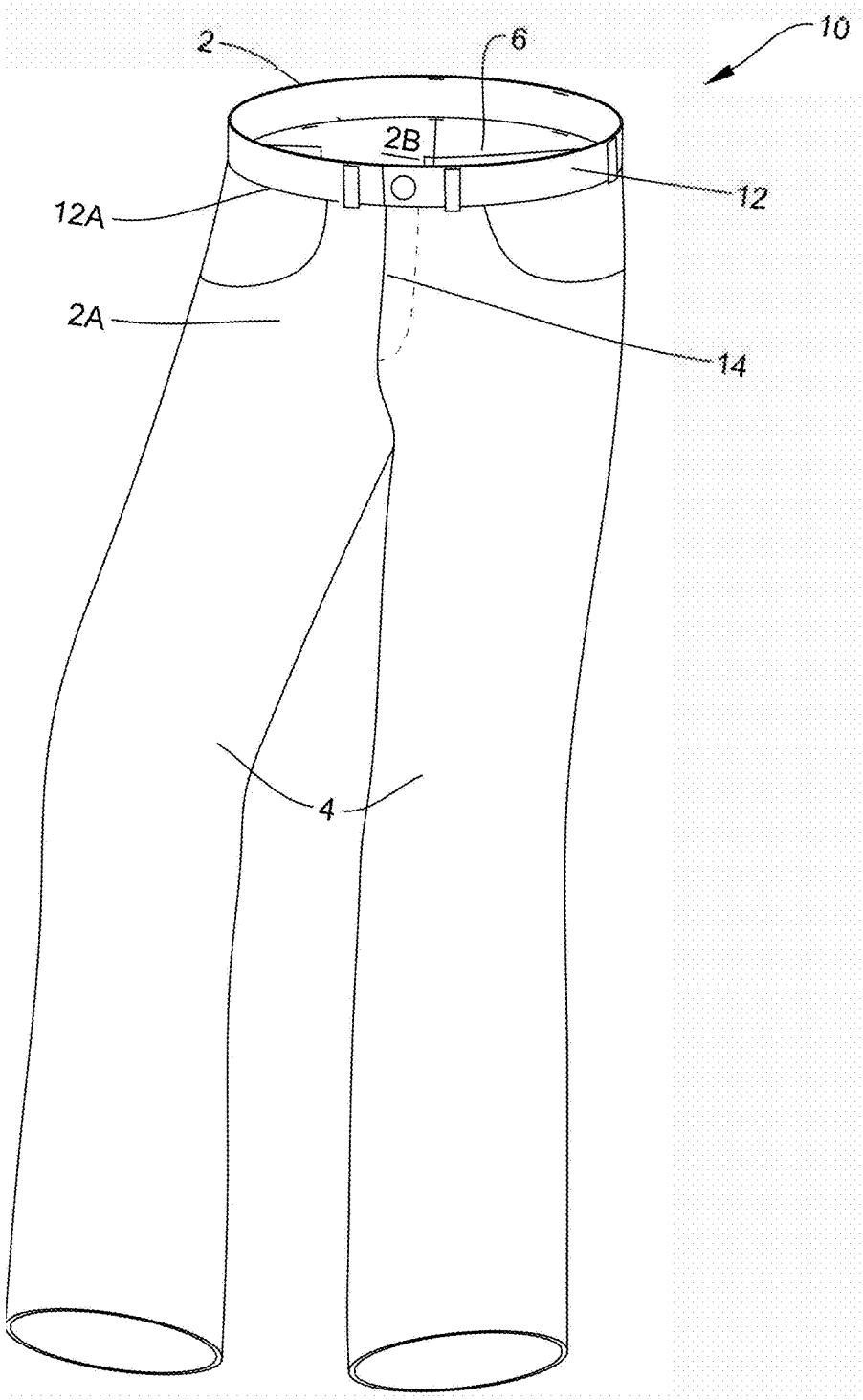
FIG. 1 is a front perspective view of the riding jeans according to various embodiments of the present invention.
Figure 2:
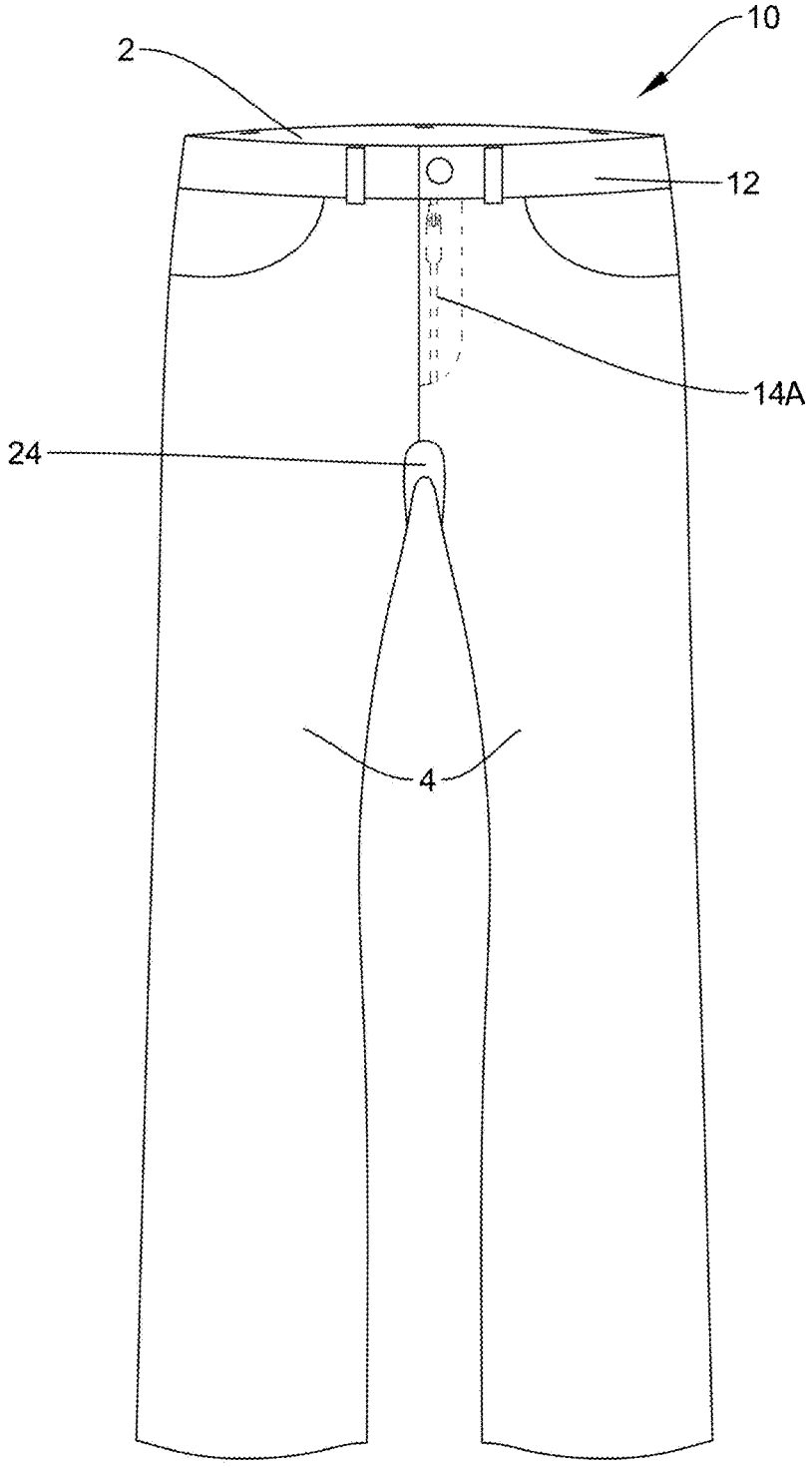
FIG. 2 is a front plan view of the riding jeans.
Figure 3:
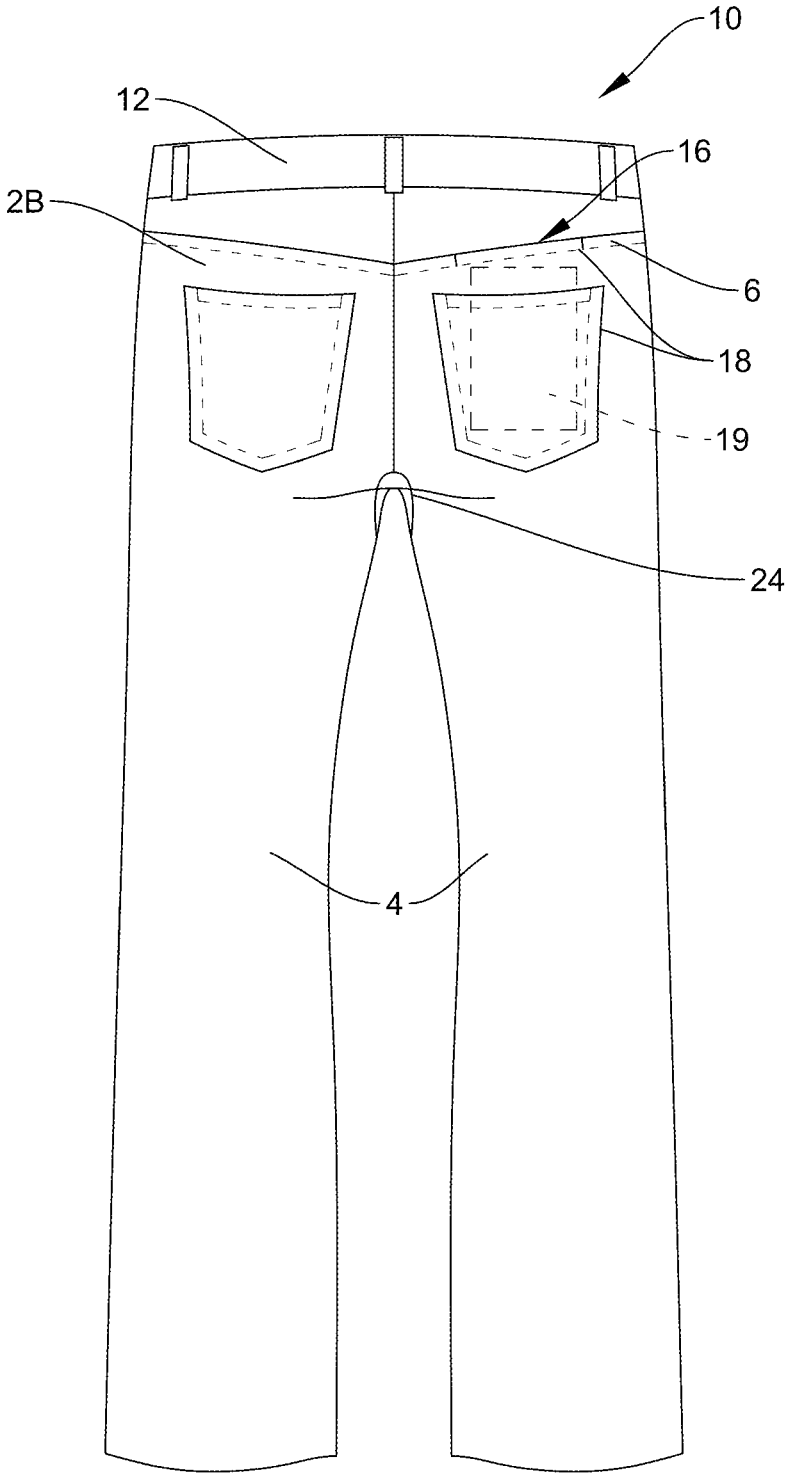
FIG. 3 is a rear plan view of the illustrated embodiment of the riding jeans.
Figure 4:
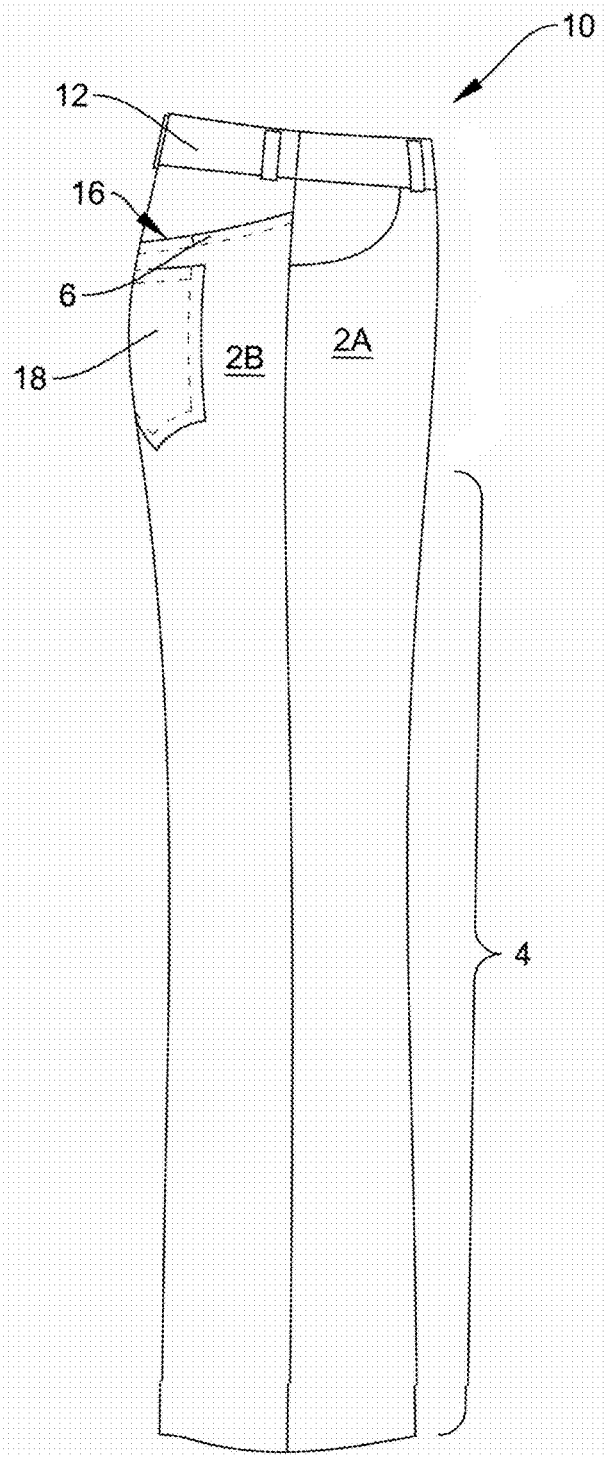
FIG. 4 is a left side view of the illustrated embodiment of the riding jeans.
Figure 5:
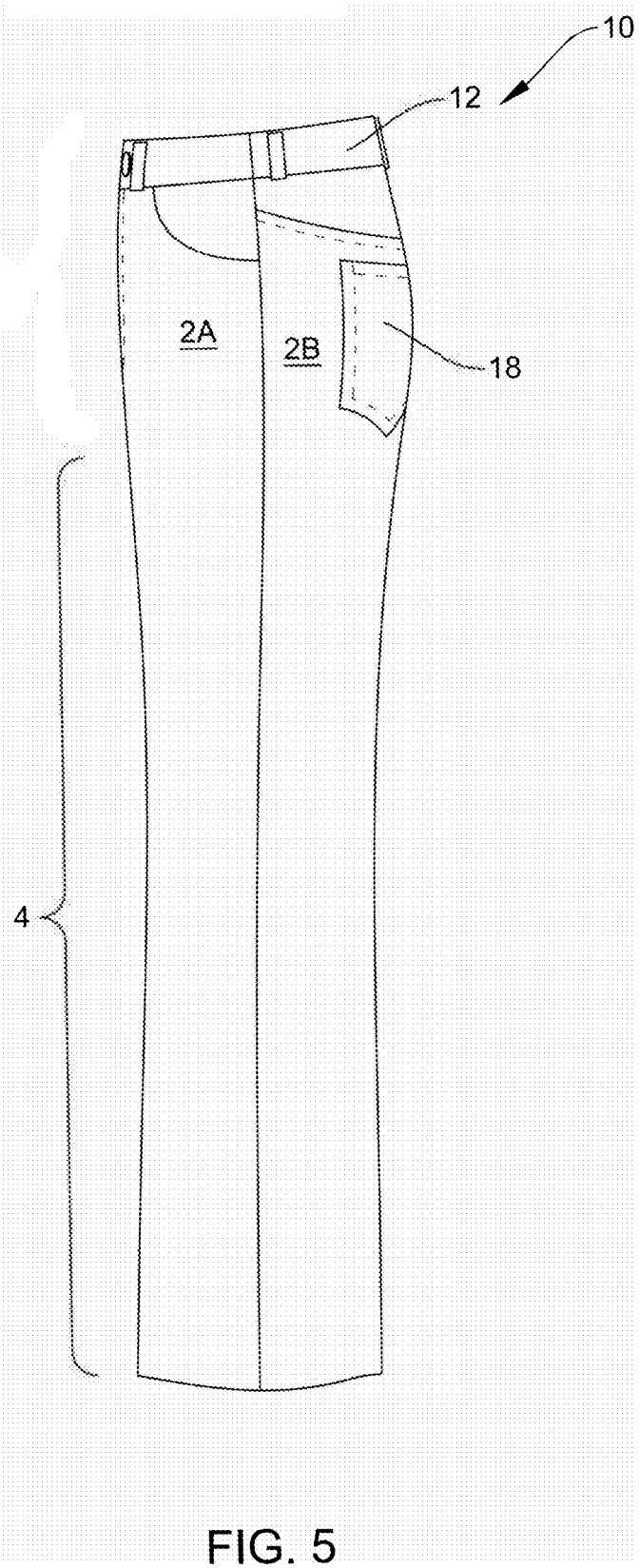
FIG. 5 is a right side of the illustrated embodiment of the riding jeans.
Figure 6:
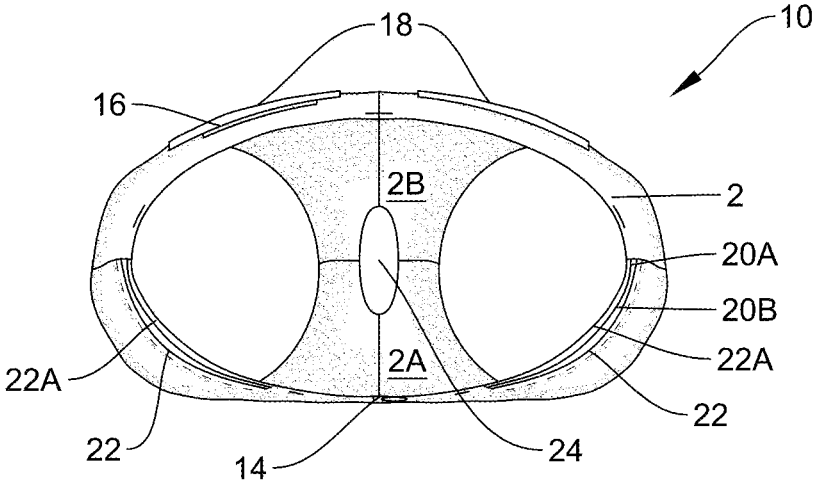
FIG. 6 is a top view of the illustrated embodiment of the riding jeans.
Figure 7:
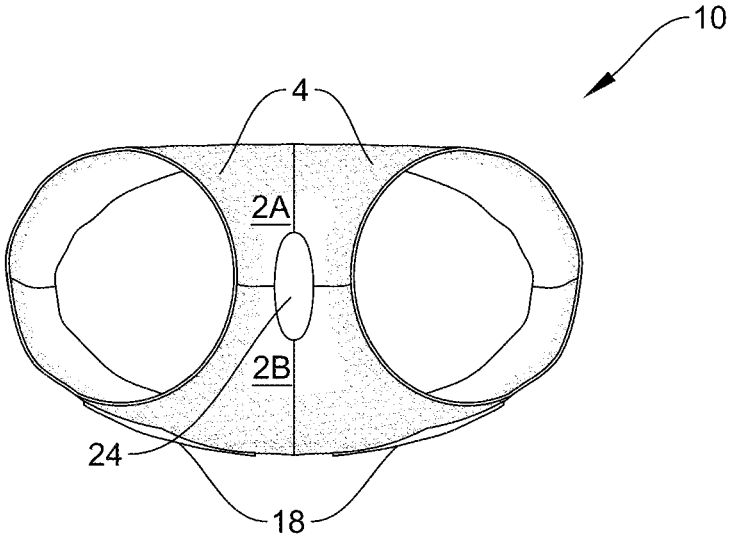
FIG. 7 is a bottom view of the illustrated embodiment of the riding jeans.

The exemplary embodiment of the riding jeans illustrated in FIGS. 1-11 includes an outer portion 10 having an open torso portion 2 configured to cover at least a portion of a wearer's torso including waistband 12 and opposed side seams 12A adjoining front side 2A configured to fit at least a portion of a wearer's lower abdomen and a rear side 2B configured to fit about at least a portion of a wearer's buttocks.

Outer portion 10 of riding jeans is composed of a heavy density fabric wherein the outer portion includes a waistband and an open torso portion 2 adjoined to the lower portion of the waistband 12. The open torso portion 2 has a front side and a rear side adjoined by a pair of opposed side seams and bifurcates downwardly at a crotch region in a pair of integral leg members.

In embodiments such as illustrated in FIGS. 1-11, front side 2A has a fastenable vertical split 14. Now referring to FIG. 2, the fastenable vertical split 14 is fastened by a zipper 14A. Fastenable vertical split 14 may in alternative embodiments be fastened by a series of buttons, clasps with corresponding hooks, magnetic fasteners, laced eyelets, snap fasteners, also called snap buttons, press buttons, press studs consisting of a pair of interlocking discs riveted with a punch and die or other commercially available fasteners.

As illustrated in FIGS. 3, 4, 5, 9 and 11, various embodiments feature yoke member 26 in rear side 2B having a top edge of an upper parallelogram-shaped portion adjoined to a corresponding lower portion of waistband 12 and opposed sides affixed to side seams of front side 12A and rear side 12B. A lower integral triangulate part of yoke member 26 has a V-shape bottom edge 6 wherein upwardly tapered bottom edges symmetrically aligned from a midline merged with a center rear seam adjoining opposed sides of rear panel 12B and leg members. Still referring to FIGS. 3, 4, 5, 9 and 11, lower V shape edge is adjoined to corresponding upper edges of rear side 12B.

Various embodiments further feature yoke member 26 having an upper parallelogram-shape portion adjoined to a lower portion of the waistband and the pair of opposed side seams and a lower triangulate portion having a V-shape bottom edge with opposed symmetrical edges adjoined to a corresponding edge of the rear side 12B of open torso portion 2 such that the V-shape is adjoined along a corresponding lower edge of rear side 2B opposite waistband 12 and wherein the bottom edge is upwardly tapered from the inverse peak at the midline vertical seam toward the pair of opposed side seams.

As further shown in FIGS. 3, 4, 5, 9 and 11, the illustrated embodiment further includes pair of rear pockets 18 disposed on rear side 2B, Rear pockets 18 are spaced equidistantly on opposed sides of the midline below yoke member 26.

Figure 9:
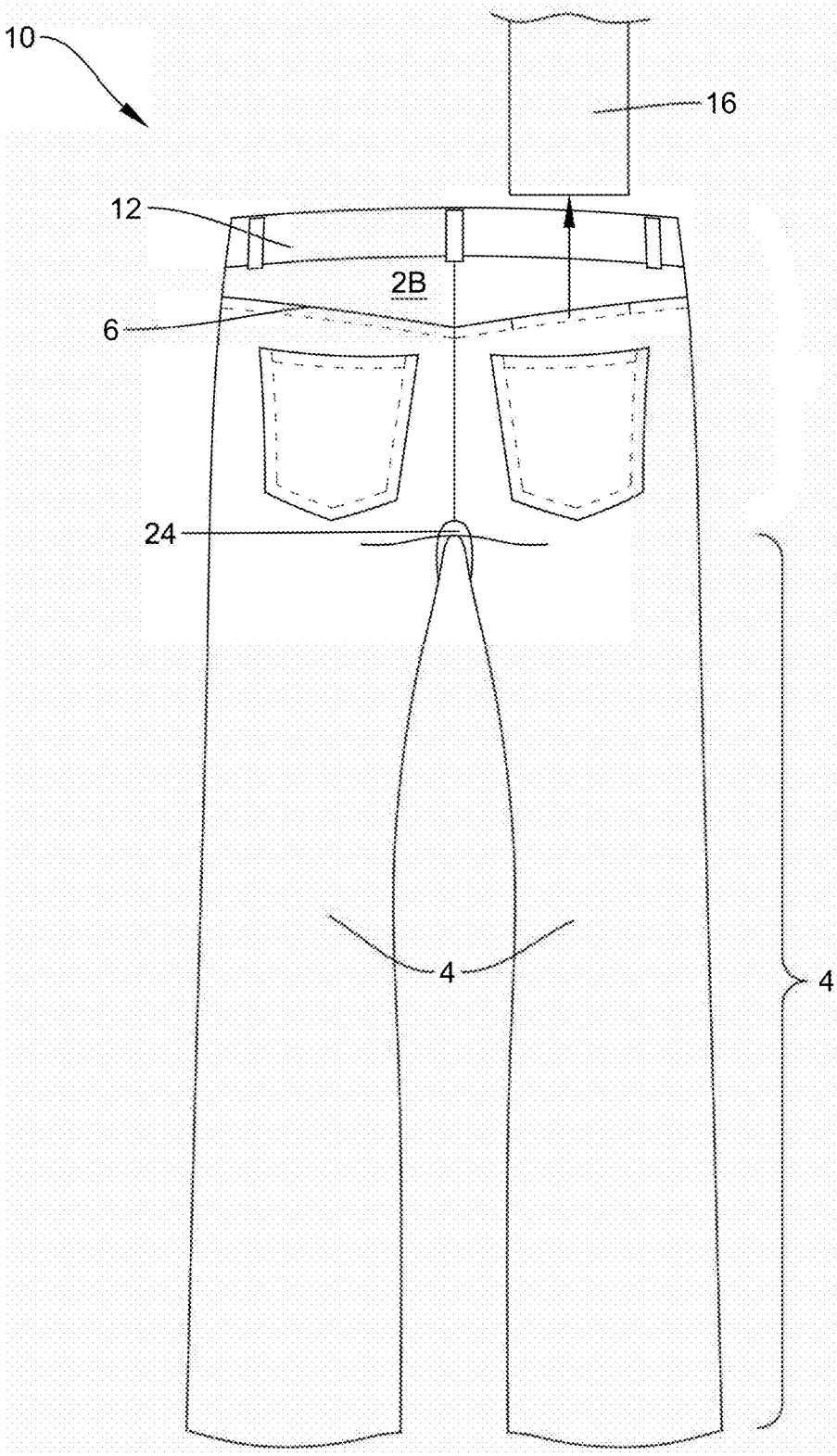
FIG. 9 is a rear view showing an interior cell phone pocket in an exploded view.
Figure 11:
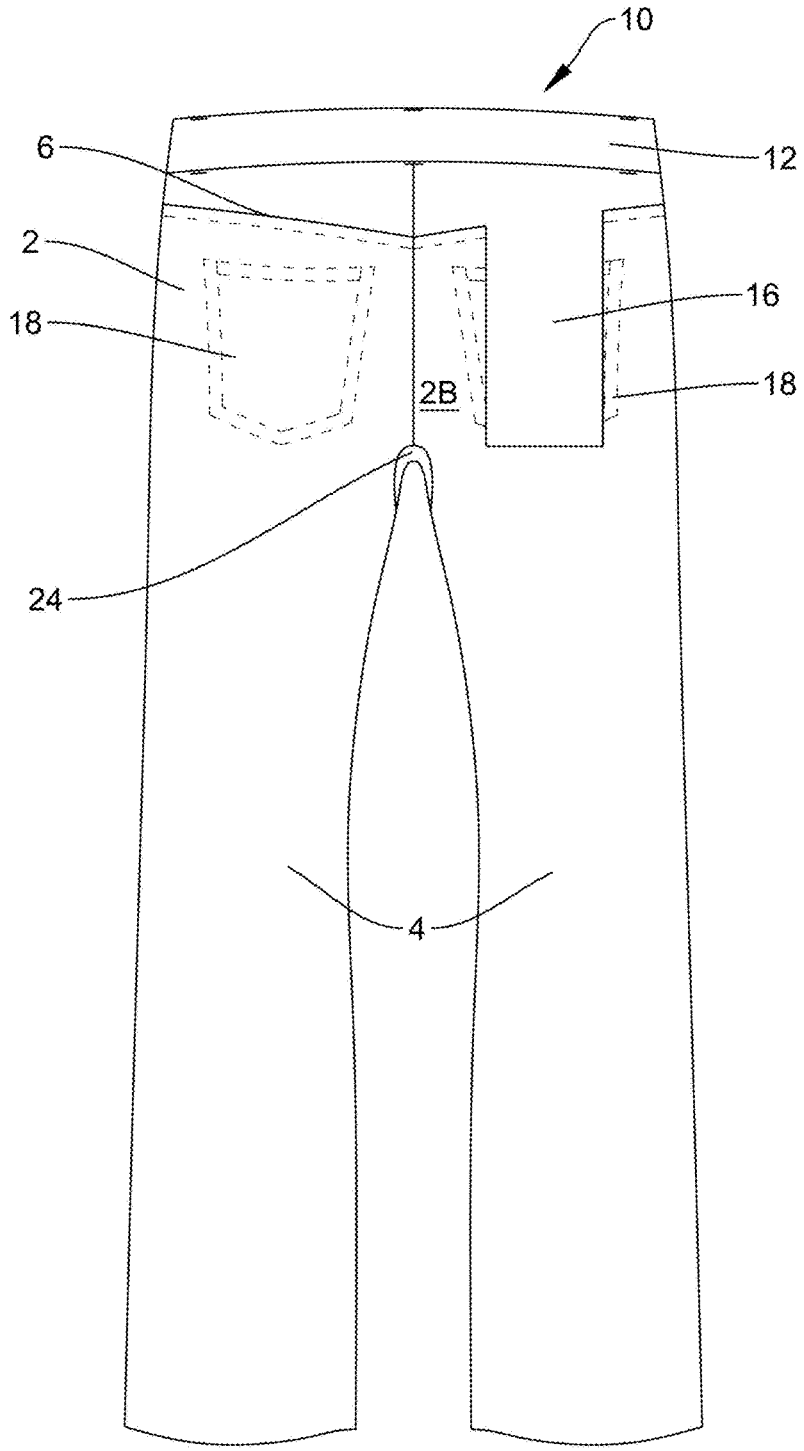
FIG. 11 is an inside out view of the rear side of the riding jeans.

Now referring to FIGS. 9 and 11, cell phone pocket 16 is configured so at least a lower portion is disposed within a periphery of rear pocket 18 and thereby hides or at least obscures a stowed cell phone the rear pocket 18. As shown, cell phone pocket 16 has an open top aligned at a corresponding portion of the V-shape edge 6, wherein cell phone 16 is inset downwardly from the open top within the outer periphery of the rear side pocket 18. In various embodiments, at least a portion of cell phone pocket 16 may be composed of lighter density fabric that is durable yet flexibly adaptive for snug stowing the cell phone in a sleeve. At least an upper portion of cell phone pocket 16 proximal to the open top may be composed of heavier density fabric. In some embodiments, a lower portion of cell phone pocket 16 extending downwardly from an upper portion is composed of the heavier density fabric. As can be readily seen, cell phone pocket 16 may be configured to fit a range of cell phone sizes.

The configuration and fabric of the cell phone pocket 16 together with its juxtaposition behind the rear pocket of the various embodiments enables secure, safe and discrete stowing of a cell phone in cell phone pocket 16. By conforming to the wearer's posterior or rear side when in various positions, i.e., standing, seated, bent over, and in motion, a cell phone 19 is held securely in place even while a rider rocks, jumps or is bumped up, down and around on a horse, bicycle, motorized sports equipment, or participating in some other activity.

In addition to hiding or at least obscuring visibility of the cell phone, positioning cell phone pocket 16 behind the two to three layers of the heavier density fabric overlaying the cell phone confers the additional advantages and functionalities of protecting a wearer's cell phone from potential damage due to impacts imposed, particularly prevalent in seated riding activities. Such protective interfacing layers of heavier density fabric of rear pockets 18 function to help prevent physical damage to the phone exterior as well as internal electronic components resulting from exterior force of impact exerted on the cell phone. Thus, a stowed cell phone is kept safe and secure within the hidden or obscured cell phone pocket 16 attenuation of high impacts exerted on the cell phone in riding activities as a wearer's lower rear torso rocks, jumps or is bumped up, down and around on a horse, bicycle or motorized sports vehicle such as, for example, a motorcycle, snowmobile, or side-by-side and other all-terrain vehicles impart improved protection of a user's cell phone 19. In some embodiments, a protective second layer to further shield the cell phone may be affixed to the outer layer of cell phone pocket 16 to enhance protective efficacies thereof.

Various embodiments feature an inner support portion 20 composed of a light density fabric configured to cover at least a lower portion of a wearer's abdomen. The top portion of inner support portion 20 may be affixed to waistband 12 by a top seam and opposed side seams of front side 2A and rear side 2B. In alternative embodiments, inner support portion 20 may extend beyond the front side of the outer portion 10 and extend about a portion or entirety of the back side of waistband 12.

As shown, exemplary inner support portion 20 features a first layer 22A adjoined to the waistband 12 and a second layer interfacing outer portion 10 configured to adjoin pair of pocket openings 22 such that inset pockets 22A extend downwardly from opposed sides of pocket openings 22 are configured by adjoining the first layer and the second layer in a seam defining the periphery of inset pockets 22A in the front side 2A of outer portion 10.

As shown, seams adjoining an outer layer 20B of the inner support portion to the pair of symmetrical front pocket openings 22 extend downwardly to configure symmetrical inset pockets 22A. Inner support portion 20 may be composed of any light density fabric. Some embodiments incorporate a small amount of a flexible material and may include a small proportion of less than 3 percent by weight of an elastane such as Spandex or Lycra® into a portion or all of inner support portion 20.

Figure 8:
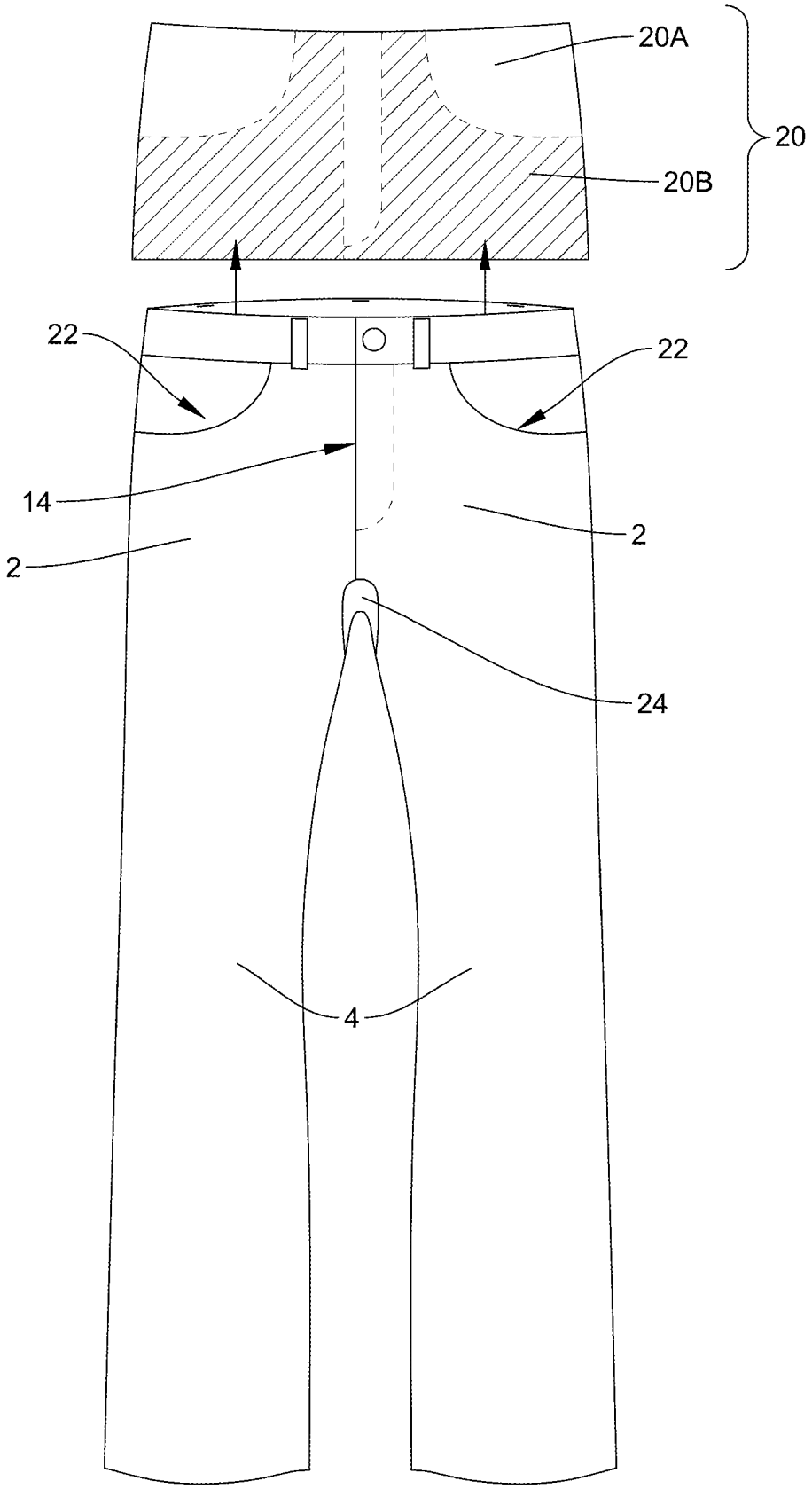
FIG. 8 is a front view showing an interior support portion in an exploded view.
Figure 10:
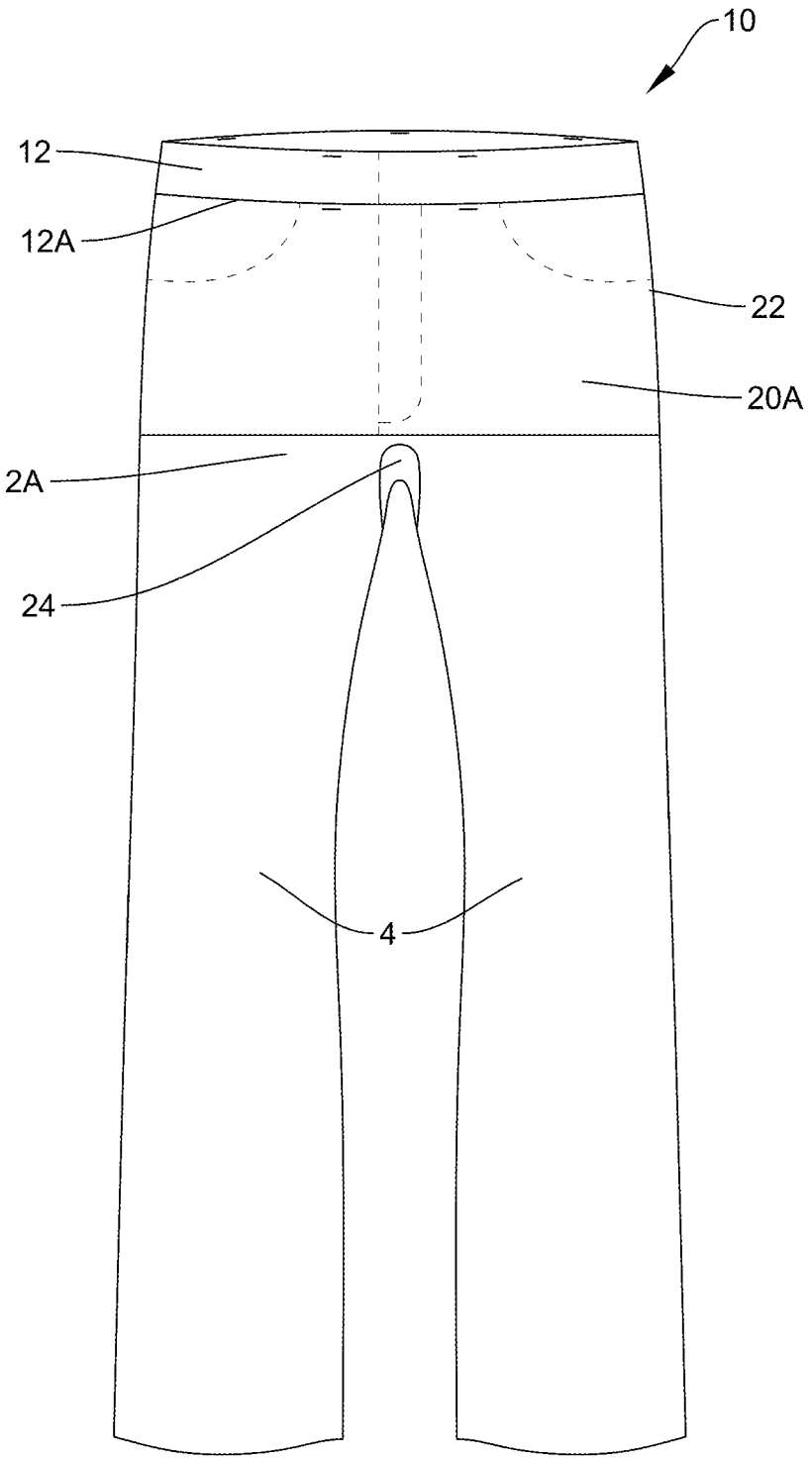
FIG. 10 is an inside out view of the front side of the riding jeans.

As best illustrated in FIGS. 8 and 10, an upper portion of inner support portion 20 may extend from or be affixed to a waistband bottom portion 12A. In alternative embodiments, inner support portion 20 may be adjoined to an upper portion of waistband 12 or directly adjoined to open torso portion 2, Various embodiments such as illustrated in FIGS. 1-11 further feature gusset member 24 disposed in the crotch region of riding jeans. In such embodiments, gusset member 24 is an oval configuration defined by a periphery where outer portion 10 is adjoined to front side 2A. As shown, a pair of opposed side edges of the periphery having an elongate curvature includes a cross-section that is perpendicularly adjoined to the opposed inner seams of the pair of integral leg members and a pair of opposed edges of the periphery having a circular radius are perpendicularly adjoined toward the lower edge of seams extended downwardly from the vertical split cross-section rear side 2B and an upper portion of leg member proximate to where outer portion 10 bifurcates are adjoined.

In alternative embodiments, the gusset member may be configured in various shapes and sizes. For example, the gusset member may be configured in a parabolic, elliptical, circular, diamond, rectangular or square configuration.

It is to be expressly understood that the illustrative embodiment and other exemplary embodiments described herein are a representation of the invention for explanatory purposes only and is not meant to unduly limit the claimed invention. While the representative embodiment of the present invention is illustrated as riding jeans, innovative features within the scope of this invention include a range of embodiments in the form of variously configured bottoms, including skirts, shorts, culottes, capris and leg members of varying styles and shapes.

Various embodiments may include conventional features, including without limitation, a number of detachable components including but not limited to removable pockets, leg members, variously configured front, side and back pockets, belt or other loops. For example, leg members may be tightly fitted in the form of "jeggings" or be a loose or wide configuration, such as, "boot cut" or flared.

It can thus be discerned that various configurations providing one or more of multiple functionalities including but not limited to, providing adaptive support and gird of a wearer's abdomen and safe, secure cell phone stowage that may not be expressly detailed or claimed herein are contemplated and fall within the scope of this invention.

The invention claimed is:

1. A riding garment, comprising:

an outer portion composed of a heavy density fabric including an open torso portion disposed downwardly from the waistband, wherein the open torso portion includes a front side and a rear side configured to cover at least a portion of a wearer's torso, wherein the front side and rear side are adjoined along a pair of opposed side seams;

an inner support portion composed of a light density fabric, wherein the inner support portion is affixed by an upper seam to a front side of the waistband and opposed side portions are affixed to the pair of opposed side seams thereby imparting a compressive abdominal support when worn; and wherein the heavy density fabric weighs no less than 3 ounces per square yard and wherein the light density fabric weighs no more than 2 ounces per square yard so as to yield a low coefficient of friction between the heavy density fabric and the light density fabric to thereby reduce clinging or folding of the front side of the open torso portion when worn; and wherein the inner support portion includes a first layer and a second layer disposed between the first layer and the outer portion, and wherein the first layer and the second layer includes a pair of inset pockets disposed downwardly from a pair of pocket openings, wherein the pair of pocket openings in the outer portion are spaced apart from a center portion on opposed sides of the front side such that the pair of inset pockets are laterally disposed within opposed sides of a midline of the front side.

2. The riding garment of claim 1, wherein the open torso portion bifurcates into a pair of integral leg members at a crotch region of the open torso portion;

at least one rear outer pocket disposed on an outer surface of the rear side of the open torso portion; and a cell phone pocket having an open top in a portion of the rear side of the open torso portion, wherein the cell phone pocket extends downwardly from the open top underneath the rear side of the open torso portion such that at least a portion of the cell phone pocket is disposed behind the rear side of the open torso portion so as to obscure a cell phone behind a periphery of the at least one rear pocket when stowed in the cell phone pocket.

3. The riding garment of claim 1, wherein the heavy density fabric of the outer portion includes no more than 3 percent by weight of an elastomer material.

4. The riding garment of claim 1, wherein the light density fabric includes no more than 2 percent by weight of an elastomer material.

5. The riding garment of claim 1, wherein the heavy density fabric of the outer portion weighs between 7 ounces per square yard and 13 ounces per square yard.

6. The riding garment of claim 3, wherein the heavy density fabric includes a denim.

7. A riding jeans, comprising:

an outer portion disposed downwardly from a waistband, wherein the outer portion includes an open torso portion configured to cover at least a portion of a wearer's lower torso having a front side and a rear side adjoined by a pair of opposed side seams, wherein the open torso portion bifurcates at a crotch region into a pair of opposed inner seams configuring a pair of integral leg members, the front side having a fastenable vertical split disposed downwardly in a midline from an uppermost edge of the waistband toward a crotch region;

a yoke member having an upper band portion adjoined to a lower portion of the waistband and sides adjoined to the pair of opposed side seams, and wherein the yoke member has a lower triangulate portion having a V-shape bottom seam symmetrically tapered upwardly from a midline of the rear side of the open torso portion toward the pair of opposed side seams;

at least on rear pocket disposed on an outer surface of the rear side beneath the yoke member; and cell phone pocket having an open top in a portion of the rear side of the open torso portion, wherein the cell phone pocket is aligned coextensively with a portion of the bottom seam, and wherein the cell phone pocket extends downwardly from the open top underneath the rear side of the open torso portion such that at least a portion of the cell phone pocket is disposed behind a periphery of at least one of the pair of rear pockets so as to obscure a cell phone behind a a periphery of the at least one rear pocket when stowed in the cell phone pocket.

8. The riding jeans of claim 7, wherein the outer portion is a high density fabric and wherein an inner support portion is comprised of a light density fabric, wherein the inner support portion is disposed in the front side of the open torso portion such that an upper portion is adjoined to a bottom portion of the waistband and the inner support portion includes opposed side edges adjoined to the pair of opposed side seams of the open torso portion, and wherein the inner support portion includes a first layer and a second layer disposed between the outer portion and the first layer; and a pair of inset pockets disposed downwardly from a pair of pocket openings between the first layer and the second layer, wherein the pair of inset pockets have a top edge adjoined to the waistband and a pair of opposed side edges adjoined toward the pair of opposed side seams of the outer portion.

9. The riding jeans of claim 7, wherein the fastenable vertical split is detachably closed with a member of the group consisting of: a zipper, a series of buttons and corresponding buttonholes, clasps and corresponding hooks, magnetic fasteners, laced eyelets, snap fasteners, press buttons and press studs consisting of a pair of interlocking discs riveted with a punch and die.

10. The riding jeans of claim 8, wherein the high density fabric weighs between 6 ounces per square yard and 13 ounces per square yard, and wherein the light density fabric weighs between 2 ounces per square yard and 3 ounces per square yard.

11. The riding jeans of claim 10, wherein the at least one rear pocket is a pair of rear pockets spaced equidistantly on opposed sides of the midline and spaced below the yoke member, and wherein high density fabric includes a denim.

12. The riding jeans of claim 7, further comprising a gusset member disposed in the crotch region, wherein the gusset member is configured to adjoin the front side and the rear side where the open torso portion bifurcates such that the pair of opposed inner seams and the front seam and the rear seam are spaced apart to thereby eliminate a cross intersection of the pair of opposed inner seams with the front and the rear seams.

13. The riding jeans of claim 8, wherein the inner support portion is comprised of a light density fabric includes less than 3 percent by weight of an elastomer.

14. Riding jeans, comprising:

an outer portion including a waistband and an open torso portion configured to cover at least a portion of a wearer's lower torso bifurcating downwardly at a crotch region, wherein the open torso portion has a front side and a rear side adjoined by a pair of opposed side seams, wherein the open torso portion bifurcates at a crotch region into a pair of opposed inner seams configuring a pair of integral leg members, the front side of the open torso portion having a zippered opening vertically disposed at a midline extended from the waistband downwardly toward the crotch region, and wherein the rear side of the open torso portion includes a yoke member having an upper portion adjoined to a lower portion of the waistband and a pair of opposed sides adjoined to the pair of opposed side seams, and wherein a lower portion of the yoke member is configured in a V-shape adjoined in a seam along the rear side of the open torso portion such that a bottom seam is symmetrically upwardly tapered from a rear seam disposed at a vertical midline of the rear side toward the pair of opposed side seams;

a pair of rear pockets equidistantly disposed on opposed sides of the midline of the rear side below the bottom seam of the yoke member on an outer surface of the rear side of the open torso portion; and a cell phone pocket having an open top aligned along a portion of the bottom seam of the V-shape periphery of the yoke member, wherein the cell phone pocket extends downwardly from the open top such that the cell phone pocket is disposed underneath the outer portion of the rear side and configured so as to obscure a cell phone behind a periphery of at least one of the pair of rear pockets when stowed in the cell phone pocket.

15. The riding jeans of claim 14, further comprising an inner support portion having a first layer and a second layer, wherein the first layer is adjoined to the lower portion of the waistband and the second layer disposed between the outer portion and the first layer, and wherein the second layer is adjoined to a pair of pocket openings equidistantly disposed from a midline of the front side, the first layer and second layer being configured to include a pair of inset pockets adjoined to opposed side seams of the open torso such that the inner support portion abuts a coextensive area of the front side of the outer portion in smooth correspondence when worn.

16. The riding jeans of claim 14, wherein the outer portion comprises a heavy density fabric including a denim having less than 3 percent by weight of an elastomer.

17. The riding jeans of claim 14, wherein the inner support portion comprises a light density including no more than 2 percent by weight of an elastomer.

18. The riding jeans of claim 14, wherein at least an upper portion of the cell phone pocket proximal to the open top is composed of the heavy density fabric.

19. The riding jeans of claim 18, wherein the cell phone pocket includes a lower portion composed of the heavy density fabric.

* * * * *